US005177939A

United States Patent [19]

Lipes

[11] Patent Number: 5,177,939

[45] Date of Patent: Jan. 12, 1993

[54] BAGGING MACHINE WITH BAG HOLDING TRANSFER AND STRETCH MEANS

[75] Inventor: Arnold Lipes, Montreal, Canada

[73] Assignee: Pamco, Inc., Quebec, Canada

[21] Appl. No.: 692,294

[22] Filed: Jul. 18, 1991

[30] Foreign Application Priority Data

Apr. 15, 1991 [CA] Canada ..... 2040495

[51] Int. Cl.[5] ..... B65B 43/16

[52] U.S. Cl. ..... 53/572; 53/284.7; 53/373.6

[58] Field of Search ..... 53/284.7, 373.6, 512, 53/571, 572, 573, 374.8

[56] References Cited

U.S. PATENT DOCUMENTS

| | | | |
|---|---|---|---|
| 3,896,605 | 7/1975 | Chevalier | 53/479 X |
| 4,078,358 | 3/1978 | Henderson | 53/373.6 X |
| 4,124,966 | 11/1978 | Wilson | 53/572 X |
| 4,370,845 | 2/1983 | Perolls et al. | 53/572 |
| 4,432,186 | 2/1984 | McGregor | 53/573 X |
| 4,510,736 | 4/1985 | Müller | 53/284.7 X |
| 5,077,958 | 1/1992 | Peppard et al. | 53/373.6 X |

*Primary Examiner*—John Sipos
*Assistant Examiner*—Daniel B. Moon
*Attorney, Agent, or Firm*—Longacre & White

[57] ABSTRACT

A bagging machine comprising an article discharge chute for releasing one or more articles in an open bag held thereunder at a bag loading position. A plurality of collapsed plastic bags are supported under and adjacent the discharge chute. The mouth of an outer one of the plastic bags is opened with a bag opening clamp and the rear and front wall of the bag are held spaced apart so as to receive one or more articles therein through the discharge chute. Bag holding and stretching fingers grip the bag at opposed upper side edge portions thereof whereby to transfer the first bag filled with the articles to a sealing station after the front and rear walls of the bag are detached from their bag opening securement. At the sealing station, a clamp engages the stretched rear and front walls together below the mouth opening and the rear and front walls together are sealed across the mouth opening above the clamp after release and removal of the bag holding and stretching fingers to effectuate a substantially crease-free seal entirely across the mouth opening of the bag.

21 Claims, 6 Drawing Sheets

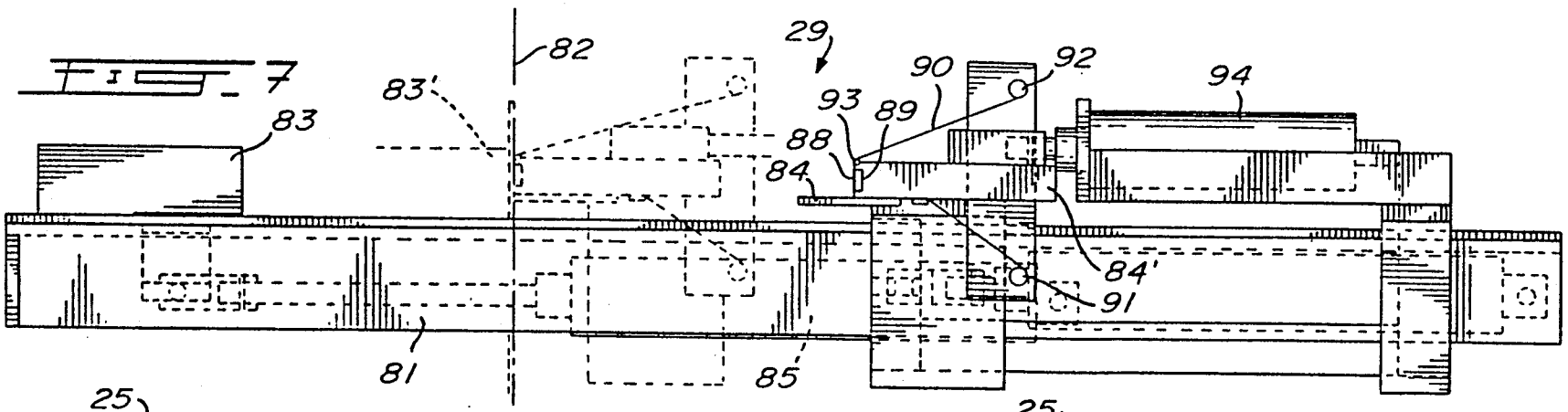
FIG. 7
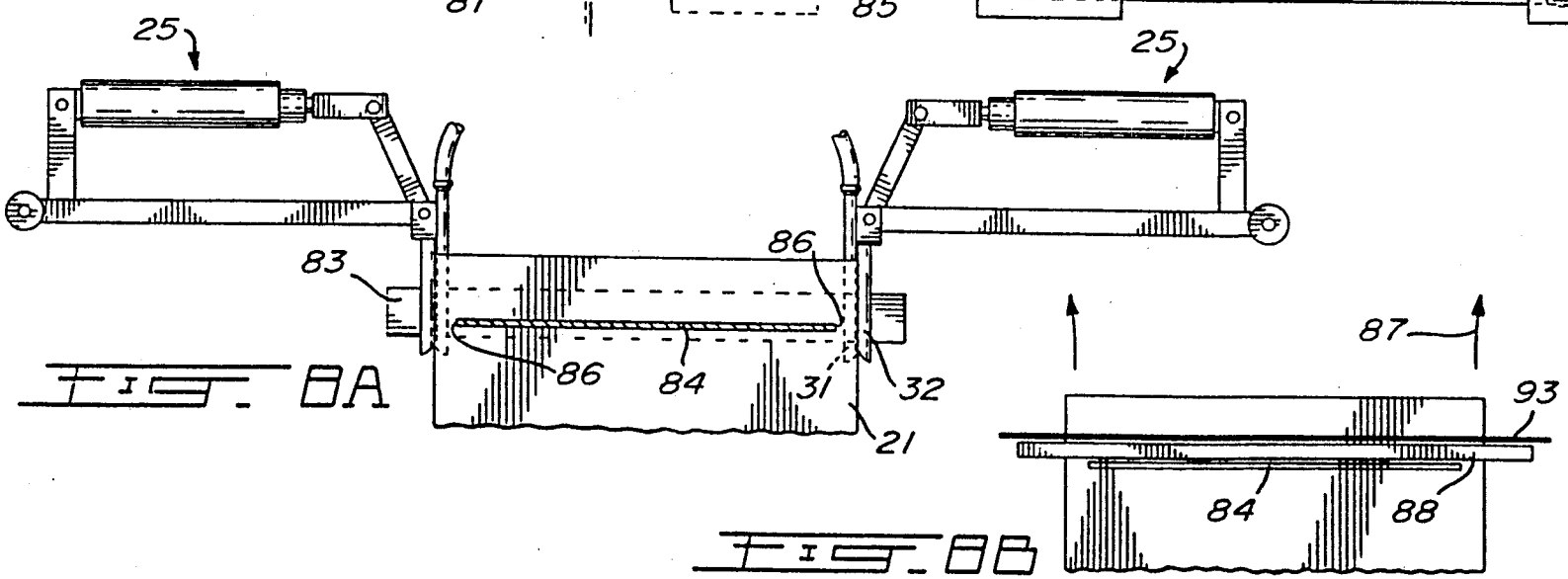
FIG. 8A
FIG. 8B

BAGGING MACHINE WITH BAG HOLDING TRANSFER AND STRETCH MEANS

BACKGROUND OF INVENTION

1. Field of the Invention

A bagging machine for filling and transferring a plastic bag from a bag loading position to a bag sealing position and wherein the transfer of the bag is effectuated by clamping fingers which engage the bag in opposed end edges whereby to stretch the bag so that the front and rear wall thereof are clamped together in a stretch condition to effect sealing of the bag entirely across the mouth opening with substantially a crease-free seal entirely across the bag.

2. Description of Prior Art

It is known to stretch open ends of plastic envelopes at a sealing station to eliminate creasing in a plastic film wrapping during the sealing cycle. For example, U.S. Pat. No. 4,024,692 discloses such an envelope sealing machine. U.S. Pat. No. 3,896,605 also teaches a bag handling machine wherein fingers enter into the bag to stretch the mouth opening. However, these fingers are not utilized to effectuate the transfer of the bag, after the bag is filled, and to stretch the mouth opening while supporting the bag to transfer it to a sealing station where a substantially crease-free seal is effectuated. Also, with the prior art, it is usually necessary to remove the bag stretching means to effectuate an evacuation of the bag when it is necessary to evacuate air therefrom prior or after sealing of the bag.

SUMMARY OF INVENTION

It is a feature of the present invention to provide a novel bagging machine wherein bag holding and stretching fingers are secured at opposed upper side edge portions of the open mouth of the bag at the filling station whereby to clamp and transfer the bag with articles therein to a bag sealing station so that a substantially crease-free seal can be made with the bag holding and stretch means removed therefrom.

Another feature of the present invention is to provide a bagging machine wherein the bag holding and stretch means is utilized to evacuate air from inside the bag just prior to the sealing of same.

Another feature of the present invention is to provide a bagging machine having bag holding and stretch means which are adjustable to suit bags of different sizes and which can be used to evacuate air from the bag immediately before sealing.

Another feature of the present invention is to provide a bagging machine having bag holding and stretch means which cooperate with a sealing station whereby to effectuate a substantially crease-free seal entirely across the mouth opening of the bag and without subjecting the hot seal to stretching by the load in the bag during the sealing thereof.

According to the above features, from a broad aspect, the present invention provides a bagging machine comprising an article discharge means for releasing one or more articles in an open bag held thereunder at a bag loading position. Means is provided for supporting a plurality of collapsed plastic bags under and adjacent the discharge means. Means is further provided for opening a mouth of an outer one of the collapsed plastic bags. The means for opening has positive bag holding means for holding a portion of the rear and front wall of the outer bag in spaced relationship to open the mouth to receive the one or more articles therein from the discharge means. Bag holding and stretch means is securable to opposed upper side edge portions of the open mouth bag for clamping and transferring the first bag, when filled with the articles, to a sealing station after the positive bag holding means are released. The bag holding and stretch means also stretch the open mouth of the bag to pull the rear and front wall taut to prevent creasing during sealing of the bag. Clamping means is provided to clamp the rear and front wall together while the bag is in a stretched condition. The clamping means is spaced below the mouth opening. Sealing means is provided to seal the front and rear wall together across the mouth opening above the clamping means after release and removal of the bag holding and stretch means to effectuate a substantially crease-free seal entirely across the mouth opening of the bag.

BRIEF DESCRIPTION OF DRAWINGS

A preferred embodiment of the present invention will now be described with reference to the accompanying drawings, in which:

FIG. 7 is a side view illustrating the detailed construction of the sealer mechanism;

FIG. 8A is an end view showing the relationship of the clamp with respect to the clamping finger elements at the bag sealing station;

FIG. 8B is similar to FIG. 8A but showing the clamping finger elements removed from the bag at the sealing station with the position of the sealing bag and the bag severing wire.

DESCRIPTION OF PREFERRED EMBODIMENTS

Figure 2:
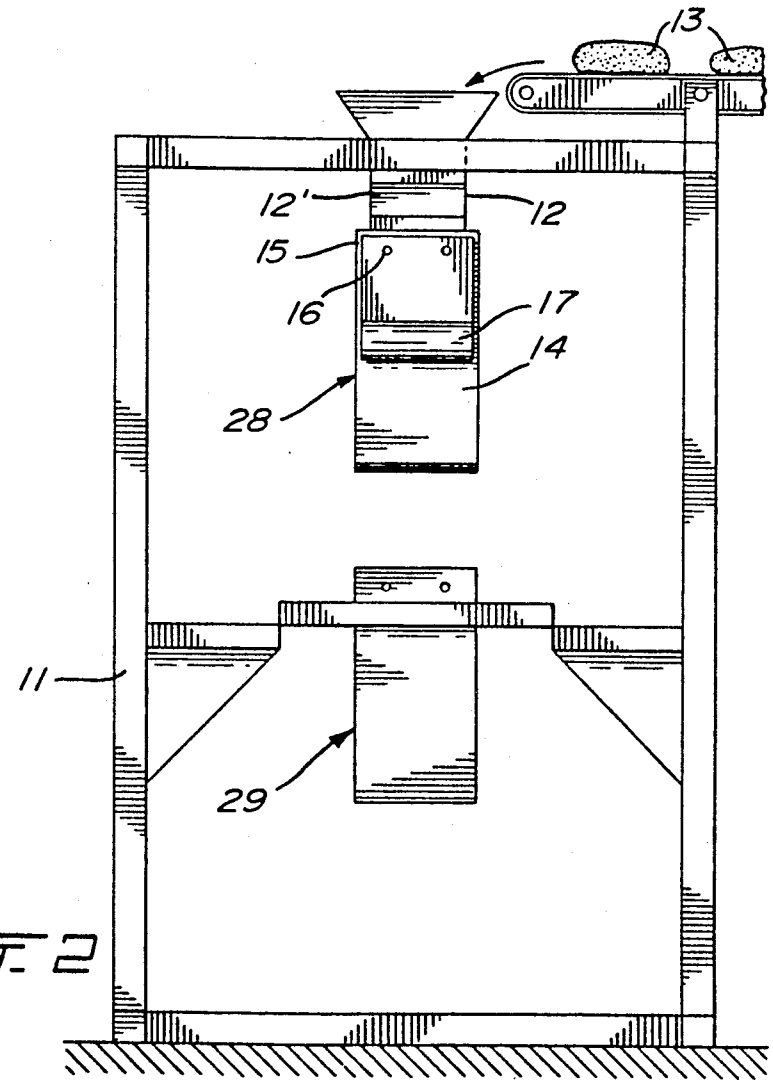
FIG. 2 is an end view of FIG. 1 showing the bag positioned at a loading station and at a sealing station.
Figure 1:
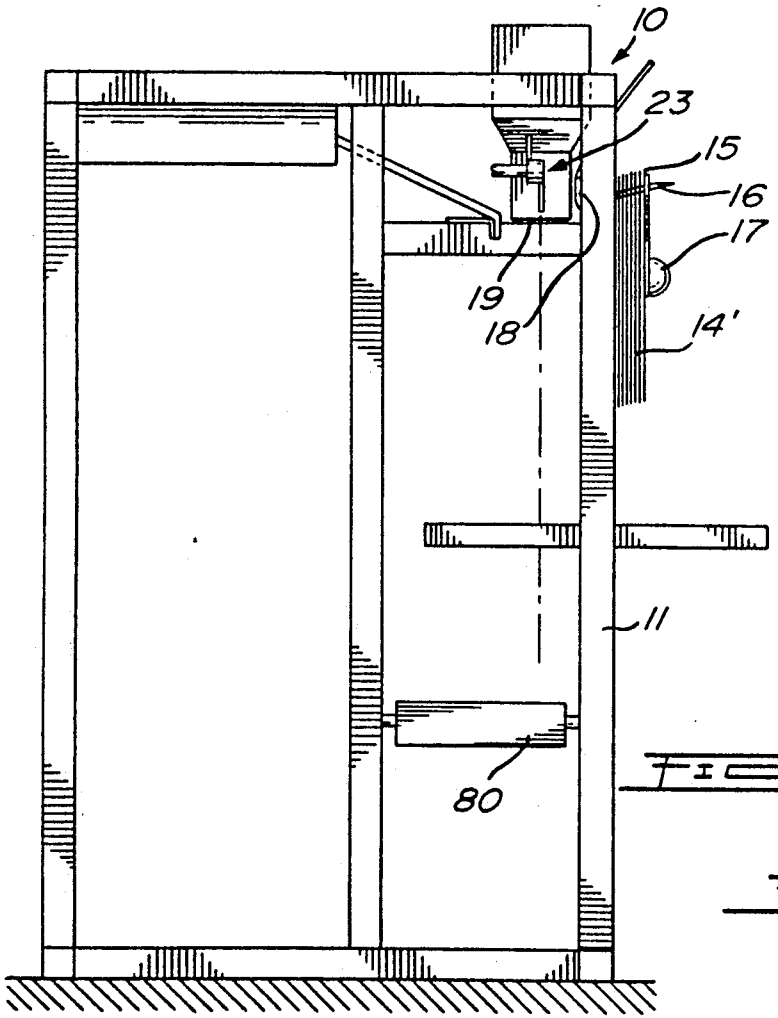
FIG. 1 is a simplified side view illustrating some of the elements of the bagging machine of the present invention.
Figure 4:
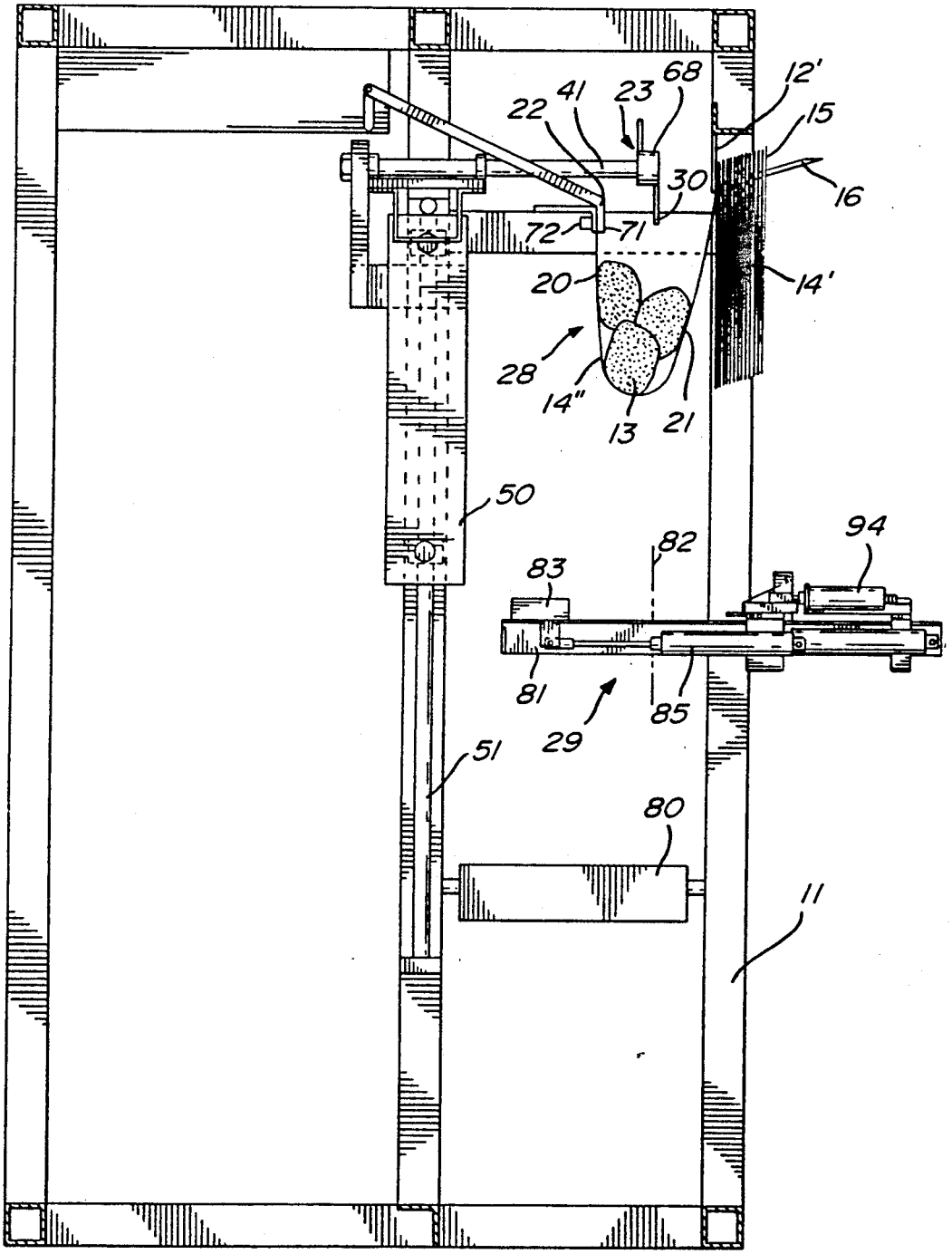
FIG. 4 is a side view illustrating the construction of the bagging machine of the present invention and the alignment between the bag loading position and the sealing station.

Referring now to the drawings, and more particularly to FIGS. 1 and 2, there is shown generally at 10, the bagging machine of the present invention and which is herein mounted on a rectangular frame 11. In an upper part of the frame, there is secured a discharge chute 12 which is fed one or more articles 13 therein for loading into a bag 14 held under the chute 12 in an open bag loading position. A plurality of collapsed plastic bags 14' are held under the chute with their tabs 15 disposed against the wall 12' of the chute and held thereagainst by inclined wicker pins 16. A load plate 17 is positioned on the wicker pins 16 against the plurality of collapsed bags 14' to keep them compressed and for movement of the collapsed bags along the pins to their loading position. An air jet 18 is disposed in the vicinity of the bottom open end 19 of the chute 12 and the slit opening of the mouth of the first bag 14'' to open the mouth of a first bag 14'', as shown in FIG. 4. The air jet blows open the front wall 20 of the bag from its rear wall 21 and a clamp 22 is displaced in the mouth opening and pulls the front wall of the bag to clamp it against a clamping surface or plate (see FIG. 9). Once the bag is open, the articles 13 are discharged therein. The bag is held by the clamp 22 and the holes in the flap 15 held by the wicker pins 16. It is also known to provide a clamping piston head against these flaps 15 to clamp the flaps between such piston head and the wall 12' of the chute. Such piston head is not shown herein but well known in the art. So far, this form of bag opening holding, and loading means is well known.

Figure 3:
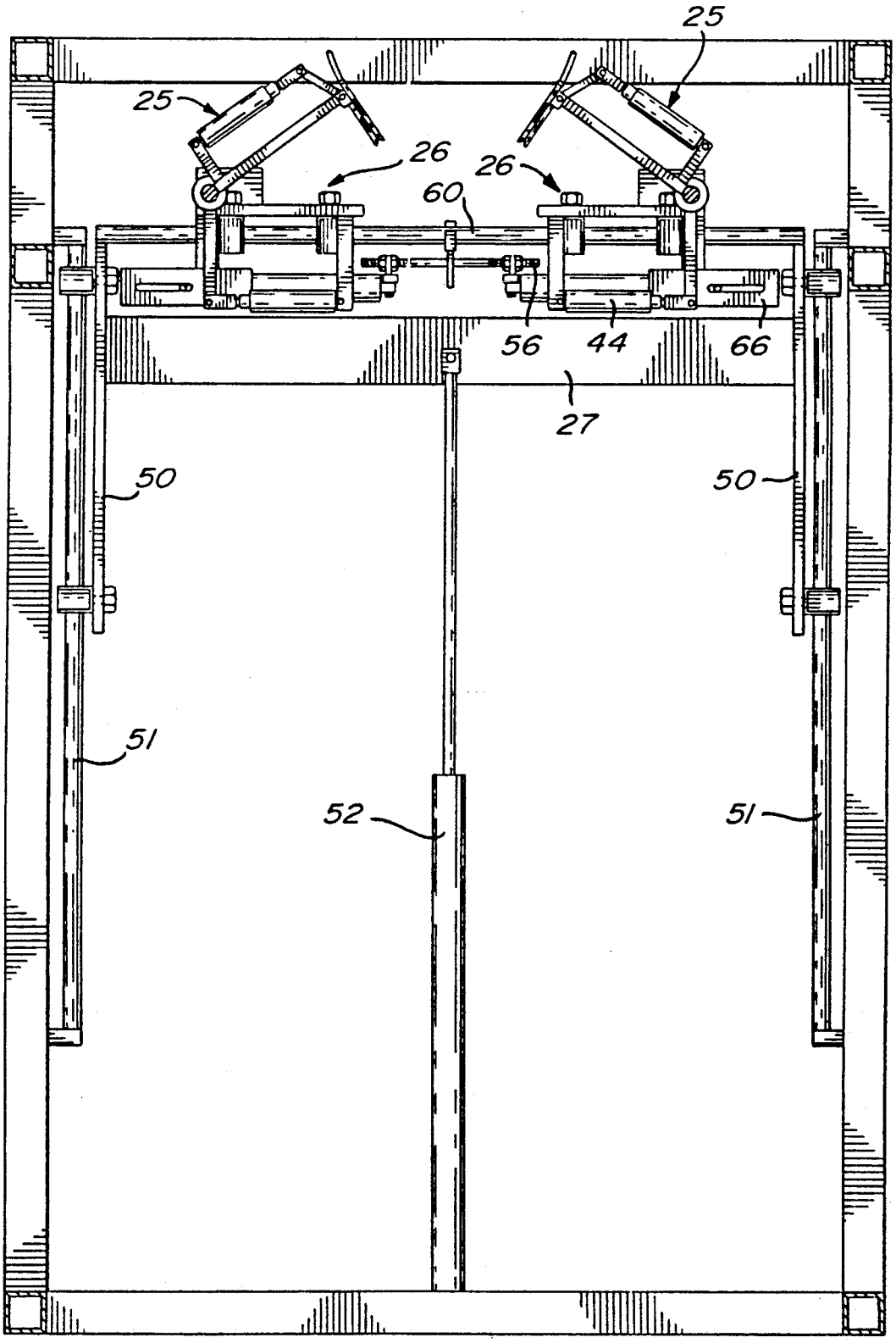
FIG. 3 is a side view illustrating the adjustable support mechanism for the bag holding and stretching clamping finger elements.

The present invention is concerned with a further bag holding and stretch means generally shown at 23 in FIG. 1 but better illustrated with additional reference to FIGS. 3 to 6. As illustrated in FIG. 3, there are two bag holding and stretch means or mechanism 25 each supported on an adjustable support means 26, with both support means being secured to a displaceable support frame 27 whereby to displace the bag holding and stretch means 25 from the bag loading position 28 to the bag sealing position 29, as shown in FIG. 2.

Figures 5, 9:
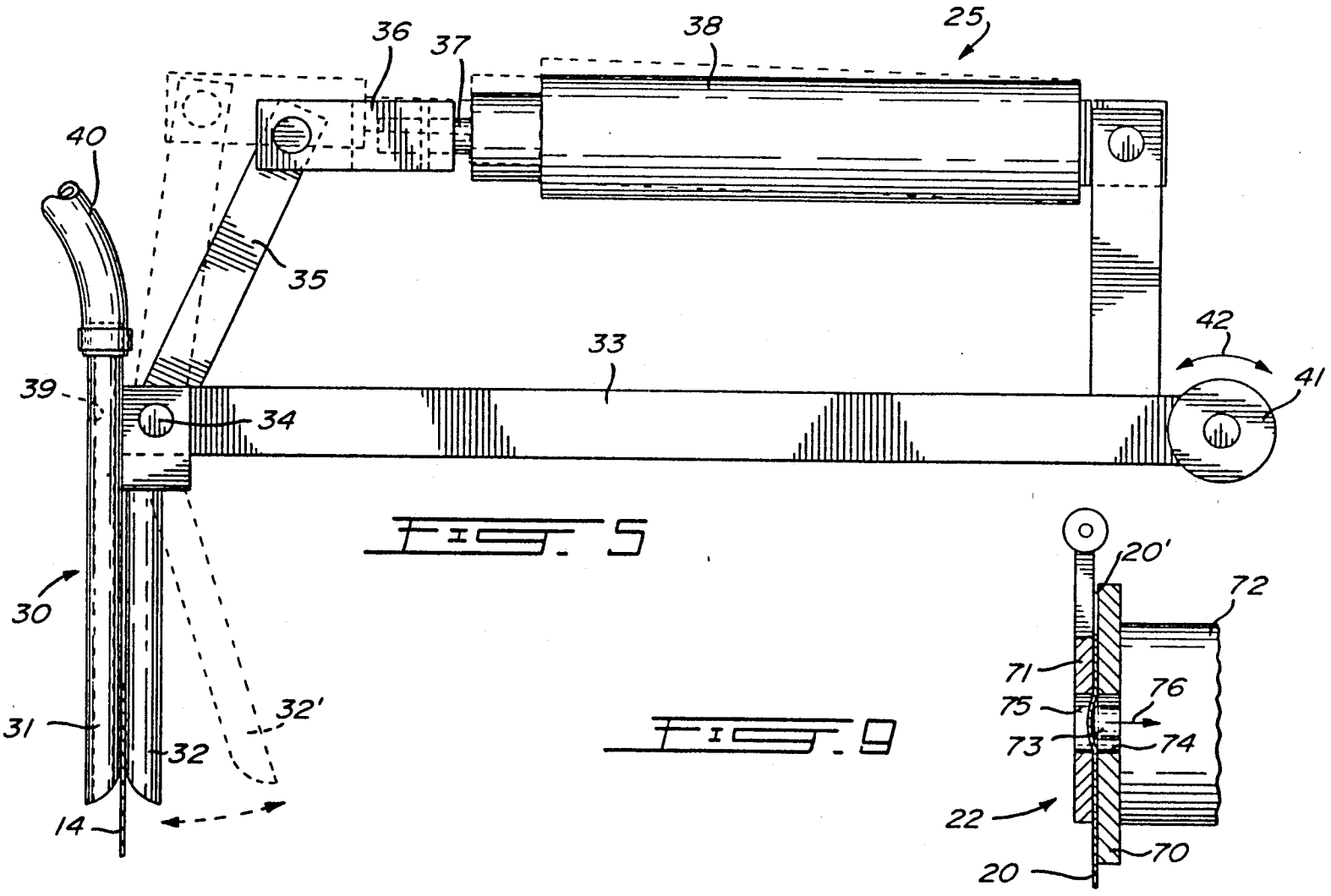
FIG. 5 is an enlarged side view of the clamping finger elements and their actuation mechanism.
FIG. 9 is a section view through the bag opening clamp showing its cooperation with a microswitch.

Describing firstly the bag holding and stretch means 25, it is comprised by a pair of clamping finger elements 30 with one of the finger elements, namely element 31, being positioned inside the open mouth of the open bag 14 while the other finger element 32 is pivotal and positioned on the outside and clamped against the upper side edge portion of the bag. This upper side edge portion is usually the side portion where the bag has a fold crease or may have a seam. As shown in FIG. 5, the inner finger 31 is immovably connected to a pivoting lever 33 and extends downwardly at right angles thereto. The outer finger element 32 is pivotally secured to the pivot lever 33 on pivot connection 34 and is connected to an actuating arm 35 which is connected to a piston rod end member 36 so that extension and retraction of the piston rod 37 by the piston cylinder 38 causes the outer finger to pivot and move into clamping or unclamping relationship with the inner finger 31.

As shown in FIG. 5, the inner finger element 31 may be a hollow finger defining a conduit 39 therein with the upper end of the inner finger element 31 being connected to a flexible conduit 40 which is connected to a suction pump (not shown) whereby to evacuate air from the bag prior to sealing, as will be described later.

Figure 6:
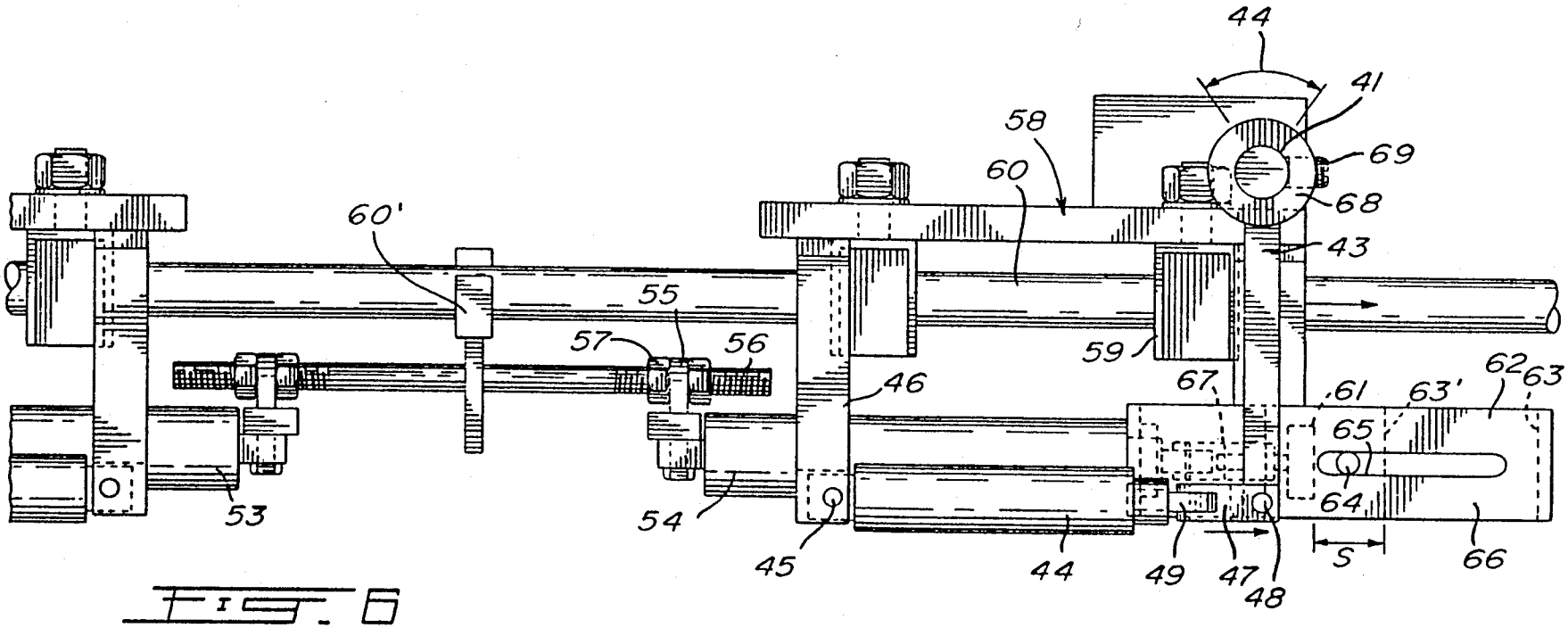
FIG. 6 is a side view illustrating the construction details of the adjustable support mechanism for the clamping finger elements.

As shown in FIG. 3, the clamping fingers are in an open condition with the outer finger element being in its position 32' as illustrated in FIG. 5. In order to position the inner clamping finger element 31 inside the bag, the pivoting lever 33 is secured to an axially rotatable connecting rod 41 which is rotatable in the directions as illustrated by arrow 42 to move the clamping finger elements 30 inside and out of the bag. One end of the rod 41 is welded to the pivot lever 33 and its other end, as shown in FIG. 6, is welded to a pivoting lever 43 which is displaced to rotate the rod 41 along the vector 44. This displacement is achieved by a finger actuating piston 44 having its cylinder pivotally connected at one end 45 to a frame member 46 while its piston rod end 47 is pivotally connected at 48 to the pivoting lever 43. Thus, when the piston rod 49 is extended, the clamping finger elements 30 will move in or out of the bag and when retracted, it will effectuate the other corresponding movement.

As shown in FIG. 3, the displaceable or movable support frame 27 is slidably connected at opposed ends by side frame members 50 to opposed slide rods 51 and displaced thereon by an actuating piston 52 whereby to transfer the loaded bag from its loading position 28 to the bag sealing station 29, as shown in FIG. 4.

Referring again to FIG. 6, the displaceable support frame also supports a pair of bag stretching pistons 53, 54 which have their piston cylinder adjustably connected at a rear end by a displaceable connector 55 secured to an adjustable rod 56. The adjustable rod is a threaded rod and the adjustable element 55 is simply a washer-like element secured to the cylinder end and secured at a desirable position along the threaded rod by means of threaded nuts 57 disposed on both sides of the washer-like element 55. This adjustable rod 56 permits lateral adjustment of a movable frame 58 which supports the rotatable connecting rod 41. The rod 56 is supported by a displaceable bracket 60' attached to a guide rod 60 at a desired fixed position. The movable frame 58 has guide bushings 59 which are displaced on the guide rod 60. Therefore, depending on the width of the bag being handled by the bagging machine, the position of the rotatable connecting rod 41 and hence the position of the clamping finger elements, can be adjusted so as to have the finger elements enter the bag at a precise location to engage the upper side edge portion of the bag open mouth.

As previously described, once the clamping finger elements have entered the bag and clamped it, and the bag is loaded, it is now ready to be transferred by the clamping finger elements and during the transfer or when the bag reaches the sealing station, the bag is stretched by the clamping finger elements. This stretching is achieved by the piston rod end 61 of the bag stretching piston 54. This piston rod end 61 is connected to the movable frame 58 and extends into a stroke adjusting member 62. The piston rod has a connector 67 to connect the piston rod end 61 to the movable frame 58. Adjusting member 62 is a sleeve member having an abutment end wall 63 which is secured at a predetermined distance from the piston rod end 61 whereby to limit the length of the stroke and, therefore, limiting the amount of stretching to be effectuated by each of the clamping finger elements. An adjustment means such as a fastening bolt 64 and slot 65 provided in a sleeve side wall 66 constitutes the adjustment means. Accordingly, if the side wall is displaced so that the abutment wall 63 is positioned as shown in phantom lines at 63', then the stroke or the amount of stretching effectuated by each clamping finger element will be that distance as shown at S.

The finger pivot lever 33 is provided with an adjustable connecting member, herein a sleeve member 68 as shown in FIG. 6, having a set screw 69 whereby to adjust the lateral position of the clamping finger elements along the rotatable connecting rod 41. This permits adjustment for the lateral position of the clamping finger elements 30 with respect to the width of the open bag at the loading position to align them with the creased side edges of the bag or the seam edges. Thus, when handling bags of different sizes, it is necessary to adjust this position. Accordingly, the clamping finger elements are adjusted in accordance with the length of the open mouth of the bag, the width of the bag, and the amount of stretching desired is also adjustable.

Referring now to FIGS. 4 and 9, and as previously described, the front wall 20 of the outermost ones of the collapsed bags 14' are clamped by clamp member 22. This clamp member is better illustrated in FIG. 9 and as herein shown, it comprises a stationary clamp plate 70 against which a movable clamp plate 71 is positioned to open a first bag and clamp an upper edge portion 20' of the front wall 20 of the bag in an open position. A microswitch 72 is secured behind the clamp plate 70 and has a spring loaded contact member 73 which extends through a hole 74 in the clamp plate 70 and extends forwardly thereof. This spring loaded contact member is also aligned with a hole 75 provided in the movable clamp plate 71 so that, when a bag is clamped, the upper edge portion 20' of the bag will obstruct the hole 75 and cause the contact member 73 to move inwardly in the direction of arrow 76 to effectuate a switch closing. This switch closing provides a signal indicative of the presence of an open bag and which initiates an operating cycle of the bagging machine. The articles may then be unloaded into the bag and the clamping finger elements move into clamping engagement with the opposed side edges of the bag. Once the clamping finger elements are engaged, and after a predetermined time delay, the clamping finger elements are displaced by the displaceable support frame 27 to the bag sealing station 29. During this transfer, the bag stretching piston 53, 54 have been actuated to displace the movable frame 58 and the rotatable cam rod 41 to effecutate stretching of the open mouth of the bag. A control circuit, not shown, but obvious to a person skilled in the art, controls the sequence of operation of the machine.

Referring now to FIGS. 7, 8A and 8B, there is shown the sealing station where the bag is sealed and released on a discharge conveyor 80 as shown in FIG. 4. The filled bag is brought into an opening of a support frame 81 along the axis 82 which is intermediate a clamp plate 83 and a clamping bar 84. The clamp plate 83 is secured to a clamp plate actuating cylinder 85 which firstly displaces the clamp plate to its position as shown by phantom lines 83'. Thereafter, the clamping bar 84 is displaced in the direction of the clamp plate whereby to clamp the stretched rear wall 21 of the bag against the stretched front wall 20. The clamping bar 84 is secured to a frame 84' and is adjustable thereon whereby to vary the width of the clamping bar, dependent on the size of the bags used, so that the opposed ends 86 of the bar are closely aligned with the inner finger member 31 which is still positioned inside the bag and which maintains the front and rear walls stretched to prevent creasing. After the clamping bar has clamped the filled bag against the clamp plate 83, the displaceable support frame 27 is then moved upwardly in the direction of arrow 87, as shown in FIG. 8B, by actuating the piston 52 whereby to move the clamping fingers to the loading position to engage a further bag while the filled bag is being sealed.

As shown in FIG. 8A, should the bag be evacuated of air by the vacuum applied to the inner finger 31, there is very little bag opening left to permit air to be admitted into the bag after the removal of the inner finger element 31. Also, the walls of the bag are collapsed against its contents. Accordingly, immediately after the inner finger element 31 moves out of the opposed narrow end portions of the bag, the heat sealing bar 88 immediately moves in against the clamp plate to seal the entire width of the bag, as shown in FIG. 8B. Because the front and rear walls were in a stretched condition and clamped in this condition, there is no crease formed in this portion. Also, because the unclamped opposed end portions are very small, it is unlikely that these will crease. In fact, they are flattened by the sealing bar 88 and do not form any creases.

The heat sealing bar 88 has a resistive heating ribbon 89 disposed on the forward face thereof and covered by a TEFLON sheet 90 which is displaceable thereover. The TEFLON sheet is wound about and between a supply reel 91 and a take-up reel 92 and the take-up reel is manually or automatically rotated from time to time to assure that a clean TEFLON section is disposed intermediate the plastic bag and the hot ribbon. This TEFLON sheet prevents molten plastic to adhere to the heating ribbon 89. A hot severing wire 93 is supported above the hot ribbon whereby to sever the excess top portion of the bag above the seal at the same time as the seal is being made. The hot wire 93 is disposed forwardly of the TEFLON sheet 90. After the bag has been sealed, the sealing bar 88 is retracted by the piston 94 with the clamping bar still in engagement so that the weight of the bag is supported between the clamping bar and the clamp plate to permit the seal to cool down and not subject the seal to the weight of the products in the bag. This also assists in obtaining a substantially crease-free seal.

It is within the ambit of the present invention to cover any obvious modifications thereof provided such modifications fall within the scope of the appended claims.

I claim:

1. A bagging machine comprising an article discharge means for releasing one or more articles into an open bag held thereunder at a bag loading position, means for supporting a plurality of collapsed plastic bags under and adjacent said discharge means, means for opening a mouth of an outer one of said collapsed plastic bags immediately adjacent said discharge means, said means for opening having positive bag holding means holding portions of a rear and a front wall of said outer bag in spaced relationship to open said mouth to receive said one or more articles therein from said discharge means; bag holding and stretching means engaging opposed upper side edge portions of said open mouth bag for clamping and vertically transferring said outer bag when filled with said articles to a sealing station below said loading position after said positive bag holding means are released and for stretching said open mouth of said bag to pull said rear and front walls taut to prevent creasing when sealing said bag, said sealing station comprising clamping means to clamp said rear and front walls together while said bag is in a stretch condition, said clamping means being spaced below said mouth opening, and sealing means to seal said rear and front walls together in a seal area across said mouth opening and above said clamping means after release and removal of said bag holding and stretching means to effectuate a substantially crease-free seal entirely across said mouth opening of said bag while said bag is supported by said clamping means which supports the load in the bag to prevent stress in said seal area above said clamping means.

2. A bagging machine as claimed in claim 1 wherein said bag holding and stretching means are each secured to an adjustable support means to position same at a desired location in said upper side edge portion of said open bag dependent on the size of said bag.

3. A bagging machine as claimed in claim 2 wherein said adjustable support means is secured to a support frame which is secured for displacement to move said bag and said bag holding and stretching means vertically from a bag loading station to a bag sealing station.

4. A bagging machine as claimed in claim 3 wherein said adjustable support means has a laterally adjustable displacement mechanism to effect said stretching of said mouth opening of said bag.

5. A bagging machine as claimed in claim 4 wherein said laterally adjustable displacement mechanism has adjustable positioning means to adjust the location of said bag holding and stretching means relative to the size of said bag.

6. A bagging machine as claimed in claim 3 wherein said clamping means comprises a first clamping member positioned across an outer surface of one of said rear and front walls of said bag, and a clamping bar positioned against an outer surface of the other of said rear and front walls between said bag holding and stretching means to clamp said stretched rear and front walls together and support said bag with said one or more articles therein after said bag holding and stretching means have been released and removed.

7. A bagging machine as claimed in claim 6 wherein said bag sealing station comprises a frame on which is supported a clamp plate secured to a piston rod, said clamp plate being positioned to a clamping and sealing position after said bag holdings and stretching means having transferred a loaded bag to said sealing station, said clamp plate constituting said first clamping member, said clamping bar being secured to a second piston rod and displaced against said clamp plate between said bag holding and stretching means, and a heat sealing bar displaceable by a third piston rod against said clamp plate and said stretched walls of said bag in said seal area above said clamping bar to effect a heat seal across said open mouth of said bag to seal said front and rear walls together.

8. A bagging machine as claimed in claim 7 wherein said heat sealing bar is a support bar having a resistive heating ribbon disposed along a sealing face thereof, and a TEFLON sheet extending over said ribbon.

9. A bagging machine as claimed in claim 8 wherein a severing hot wire is disposed above said ribbon and outwardly of said TEFLON sheet to sever portions of said front and rear walls of said bag above said seal.

10. A bagging machine as claimed in claim 8 wherein said TEFLON sheet is wound about and between a supply reel and take-up reel to displace same over said ribbon to prevent molten plastic from adhering to said heating ribbon.

11. A bagging machine as claimed in claim 7 wherein said clamping bar is provided with adjustment means to vary the length of said bar depending on the width of said bags.

12. A bagging machine as claimed in claim 2 wherein said bag holding and stretching means each comprise a pair of clamping finger elements, one of said finger elements being positioned inside said mouth opening in said opposed upper side edge portions and the other finger element being positioned on the outside of said mouth opening, one of said finger elements being a pivotally displaceable finger element to effectuate said clamping of said bag.

13. A bagging machine as claimed in claim 12 wherein said other finger element is secured to a pivoting lever member secured to a piston actuated rod to effectuate a pivotal displacement of said other finger element to clamp it against an outside surface of said bag and against said finger element positioned inside said bag with said bag clamped between said finger elements.

14. A bagging machine as claimed in claim 12 wherein said one of said finger elements is provided with a conduit secured to a suction pump whereby to evacuate air from said bag prior to said sealing of said mouth opening.

15. A bagging machine as claimed in claim 14 wherein said one of said finger elements is a rigid hollow tubular member constituting said conduit, and a flexible evacuation tube connected to said one of said finger members, said hollow tubular member being stationary with respect to said adjustable support means.

16. A bagging machine as claimed in claim 12 wherein said adjustable support means comprises a displaceable adjusted mechanism connected to a clamping finger pivot lever to which is secured a first finger actuating piston for pivotally displacing said finger member, an axially rotatable connecting rod interconnecting said finger support member to said displaceably adjusted mechanism, said displaceably adjusted mechanism having a movable frame to which is secured a second finger actuating piston, said second finger actuating piston having a piston rod connected to said axially rotatable connecting rod through a pivoting lever to cause said rod to rotate to effectuate said pivoting lever of said finger member to clamp and release said bag, said movable from being slidably connected to a slide rod forming part of said displaceably adjusted mechanism, and a bag stretching piston having its cylinder connected to a rod having adjusting means to permit lateral adjustment of said movable frame on said slide rod and of said clamping finger support member to adjust the clamping position of said finger element depending on the size of said bags.

17. A bagging machine as claimed in claim 16 wherein said bag stretching piston has a piston rod end connected to said movable frame to displace said finger support member laterally outwards to effectuate said stretching when the piston rod of said stretching piston is extended, the extension of said piston rod being adjustably controlled by a stroke adjustment member.

18. A bagging machine as claimed in claim 17 wherein said stroke adjustment member constitutes said displaceably adjusted mechanism and comprises an adjustable abutment wall positioned in alignment with said piston rod end and adjustably retained at a desired position to restrict the stroke length of said piston rod dependent on the amount of stretching desired, said piston rod having a connector secured to said movable frame to displace said frame on said slide rod.

19. A bagging machine as claimed in claim 16 wherein said finger pivot lever is provided with a connecting member to secure same to said axially rotatable connecting rod, said connecting member permitting adjustment of the width portion of said clamping finger elements relative to said upper side edge portion of said bag.

20. A bagging machine as claimed in claim 16 wherein said movable frame is secured between two vertical support guide rods, and a piston to displace said movable frame along said guide rods from said bag loading piston to said bag sealing station located below said loading position.

21. A bagging machine as claimed in claim 2 wherein said means for opening a mouth of an outer one of said bags comprises a movable clamp plate which moves inside said mouth opening and which when actuated pulls an upper edge portion of said front wall against a stationary clamp wall, said clamp plate having a hole therein to receive a spring load contact member of a microswitch connected behind said stationary clamp and extended therethrough, said contact member being displaced axially to effectuate a switch closure to initiate an operating cycle of said bagging machine when said hole in said movable clamp plate is obstructed by the presence of said front wall of said bag clamped between said movable clamp plate and said stationary clamp thereby ensuring that said outer bag is in position to receive said articles therein.

* * * * *